US008431307B2

(12) United States Patent
Kim et al.

(10) Patent No.: US 8,431,307 B2
(45) Date of Patent: Apr. 30, 2013

(54) ELECTROGRAPHIC TONER AND METHOD OF PREPARING THE SAME

(75) Inventors: Jae-hwan Kim, Seoul (KR); Kyeong Pang, Suwon-si (KR); Jin-mo Hong, Yongin-si (KR); Su-bum Park, Daegu Metropolitan (KR); Jeong-hyun Lee, Suwon-si (KR); Mi-rim Cho, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 152 days.

(21) Appl. No.: 12/917,687

(22) Filed: Nov. 2, 2010

(65) Prior Publication Data

US 2011/0104605 A1 May 5, 2011

(30) Foreign Application Priority Data

Nov. 2, 2009 (KR) ..... 10-2009-0104987

(51) Int. Cl.
*G03G 9/00* (2006.01)

(52) U.S. Cl.
USPC ..... 430/110.2; 430/109.1; 430/109.4

(58) Field of Classification Search ..... 430/109.1, 430/109.4, 110.2
See application file for complete search history.

(56) References Cited

U.S. PATENT DOCUMENTS

| | | | | |
|---|---|---|---|---|
| 7,488,562 | B2 * | 2/2009 | Daimon et al. | 430/109.1 |
| 7,575,841 | B2 * | 8/2009 | Daimon et al. | 430/109.4 |
| 7,642,031 | B2 * | 1/2010 | Daimon et al. | 430/109.3 |
| 7,713,669 | B2 * | 5/2010 | Mizutani et al. | 430/109.4 |
| 7,981,584 | B2 * | 7/2011 | Zhou et al. | 430/110.2 |
| 2006/0204880 | A1 * | 9/2006 | Mizutani et al. | 430/109.4 |
| 2006/0292477 | A1 * | 12/2006 | Daimon et al. | 430/109.4 |
| 2007/0048647 | A1 * | 3/2007 | Daimon et al. | 430/110.2 |
| 2007/0166636 | A1 * | 7/2007 | Daimon et al. | 430/109.3 |
| 2008/0187854 | A1 * | 8/2008 | Yoshida et al. | 430/109.4 |
| 2009/0220882 | A1 * | 9/2009 | Zhou et al. | 430/109.3 |

* cited by examiner

*Primary Examiner* — Stewart Fraser
(74) *Attorney, Agent, or Firm* — Stanzione & Kim, LLP

(57) ABSTRACT

The disclosure provides an electrographic toner having a core layer, which includes a binder, a colorant and two or more types of releasing agents, and a shell layer covering the core layer, and a method of preparing the same.

7 Claims, 2 Drawing Sheets

ELECTROGRAPHIC TONER AND METHOD OF PREPARING THE SAME

CROSS-REFERENCE TO RELATED PATENT APPLICATION

This application claims the benefit of Korean Patent Application No. 10-2009-0104987, filed in the Korean Intellectual Property Office on Nov. 2, 2009, the disclosure of which is hereby incorporated by reference in its entirety for all purposes.

TECHNICAL FIELD

The present disclosure generally relates to an electrographic toner, and a method of preparing the same.

BACKGROUND OF RELATED ART

In electrophotographic and electrostatic recording processes, developer is used to visualize an electrostatic image or an electrostatic latent image. Developers can be classified broadly into two types: a two-component developer including toner and carrier particles; and a one-component developer exclusively of toner. One-component developers can be further classified into magnetic one-component developers and nonmagnetic one-component developers. To increase the fluidity of toner, a fluidizing agent such as colloidal silica is often independently added to nonmagnetic one-component developers. Typically, toner includes coloring particles obtained by dispersing a colorant such as carbon black or other additives in a latex.

Methods for preparing toner include pulverization and polymerization processes. In pulverization processes, toner is obtained by melting and mixing a synthetic resin with a colorant and, if required, other additives; pulverizing the mixture; and sorting the particles until particles of desired size are obtained. In polymerization processes, a polymerizable monomer composition is manufactured by uniformly dissolving or dispersing various additives, such as a colorant, a polymerization initiator and, if required, a cross-linking agent and an antistatic agent, in a polymerizable monomer. The polymerizable monomer composition may be dispersed in an aqueous dispersive medium, which includes a dispersion stabilizer, using an agitator to shape the minute liquid droplet particles. Subsequently, the temperature of the dispersion may be increased, and suspension polymerization is performed to obtain polymerized toner having coloring polymer particles of a desired size.

Conventionally, toner used in an imaging apparatus is obtained through a pulverization process. However, during pulverization, it may be difficult to precisely control the particle size, geometric size distribution, and structure of toner, and it may thus also be difficult to separately control the major characteristics of toner, such as charging characteristics, fixability, flowability, and preservation characteristics.

Polymerized toner processes have drawn increasing attention due to the ease of controlling the size of the particles, and for not requiring complex manufacturing processes such as sorting. When toner is prepared through a polymerization process, polymerized toner having a desired particle size and particle size distribution may be obtained without pulverizing or sorting.

Conventionally, when polymerized toner is manufactured, styrene and acrylate copolymers are used as the binder resin. However, as color toner is used in a wider range of applications, more transparent resins may be required. In addition, as an awareness of environmental issues increases, lower energy and more environmentally friendly processes are often being required. Improved electrographic toner and methods for preparing the same are thus desirable.

SUMMARY OF THE DISCLOSURE

Aspects of the present disclosure provides an electrographic toner and methods for preparing the same, which addresses the above discussed and/or other concerns.

According to one aspect the disclosure, an electrographic toner may be provided to include a core layer including a binder, a colorant, and two or more types of releasing agents; and a shell layer covering the core layer, wherein the binder contains a non-crystalline polyester resin and a crystalline polyester resin, wherein the amount of the non-crystalline polyester resin is 70 weight (wt) % or more, and the amount of the crystalline polyester resin is 30 wt % or less, based on the total amount of the binder, and the non-crystalline polyester resin, the crystalline polyester resin, and a major releasing agent that accounts for 60% or more of the total amount of the two or more types of releasing agents satisfy the following:

$$SP(A)-SP(B)\geqq 3.0 \quad (1)$$

$$SP(B)-SP(W)\leqq 2.0 \quad (2)$$

$$10{,}000\leqq Mw(B)\leqq 30{,}000 \quad (3)$$

$$1.5\%\leqq Mw(B,\text{ less than }1{,}000)\leqq 5.0\% \quad (4)$$

where SP(A), SP(B), and SP(W) respectively denote solubility parameters (unit: $(J/cm^3)^{1/2}$) of the non-crystalline polyester resin, the crystalline polyester resin, and the major releasing agent, Mw (B) denotes a weight average molecular amount of a tetrahydrofuran (THF)-soluble component contained in the crystalline polyester resin measured by gel permeation chromatography (GPC), and Mw (B, less than 1,000) denotes a molecular weight range of less than 1,000 g/mole of the THF-soluble component contained in the crystalline polyester resin measured by GPC.

According to another aspect the disclosure, an electrographic toner may be provided to include a core layer including a binder, a colorant, and two or more types of releasing agents; and a shell layer covering the core layer, wherein the two or more types of releasing agents are polyethylene-based wax, polypropylene-based wax, silicon wax, paraffin-based wax, ester-based wax, carnauba wax, or metallocene wax.

According to another aspect the disclosure, an electrographic toner may be provided to include a core layer including a binder, a colorant, and two or more types of releasing agents; and a shell layer covering the core layer, wherein the major releasing agent comprises paraffin-based wax.

According to another aspect the disclosure, an electrographic toner may be provided to include a core layer including a binder, a colorant, and two or more types of releasing agents; and a shell layer covering the core layer, wherein the toner further comprises about 3 to about 30,000 ppm of silicon (Si), and about 3 to about 30,000 ppm of iron (Fe).

According to another aspect the disclosure, an electrographic toner may be provided to include a core layer including a binder, a colorant, and two or more types of releasing agents; and a shell layer covering the core layer, wherein the volume average particle diameter of the toner is in the range of about 3 to about 8 μm.

According to another aspect the disclosure, an electrographic toner may be provided to include a core layer including a binder, a colorant, and two or more types of releasing agents; and a shell layer covering the core layer, wherein the average circularity of the toner is in the range of about 0.940 to about 0.980.

According to another aspect the disclosure, an electrographic toner may be provided to include a core layer including a binder, a colorant, and two or more types of releasing agents; and a shell layer covering the core layer, wherein the volume average particle size distribution coefficient (GSDv) and a number average particle size distribution coefficient (GSDp) of the toner are about 1.25 or less, and about 1.3 or less, respectively.

According to another aspect the disclosure, a method of preparing an electrographic toner may include the steps of a) mixing primary binder particles, a colorant dispersion, and a releasing agent dispersion including two or more types of releasing agents, thereby preparing a mixed solution; b) adding an agglomerating agent to the mixed solution to form a core layer including primary agglomerated toner; and c) covering the core layer with a shell layer including secondary binder particles formed by polymerizing one or more polymerizable monomers, thereby preparing secondary agglomerated toner, wherein the toner is as described herein.

According to another aspect the disclosure, methods of preparing an electrographic toner may include coating tertiary binder particles on the secondary agglomerated toner.

According to another aspect the disclosure, the releasing agent dispersion may comprise a paraffin-based wax and an ester-based wax.

According to another aspect the disclosure, the releasing agent dispersion may comprise a paraffin-based wax and an ester-based wax, wherein an amount of the ester-based wax is in the range of about 5 to about 39 wt % based on the total weight of the paraffin-based wax and the ester-based wax.

According to another aspect the disclosure, the agglomerating agent may comprise a metal salt containing Si and Fe.

According to another aspect the disclosure, the agglomerating agent may comprise poly silica iron.

BRIEF DESCRIPTION OF THE DRAWINGS

Various features and advantages of the present disclosure will become more apparent by describing in detail exemplary embodiments thereof with reference to the attached drawings in which.

DETAILED DESCRIPTION OF SEVERAL EMBODIMENTS

Figure 1:
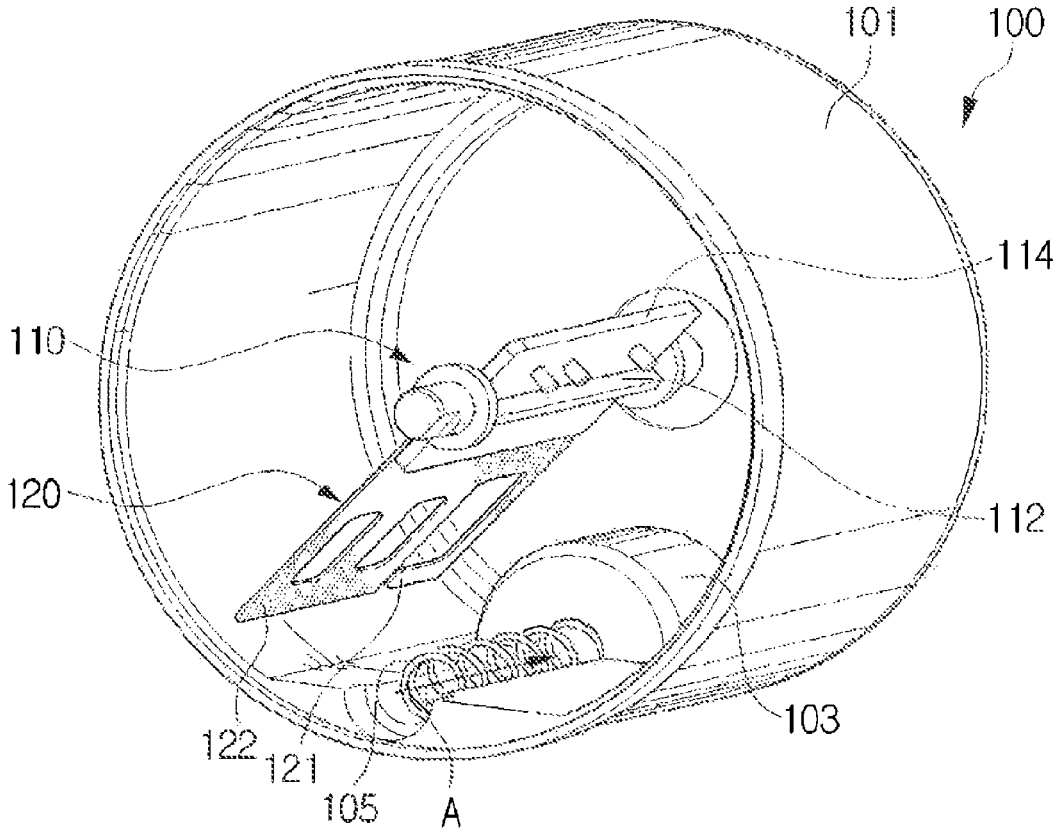
FIG. 1 is a perspective view of a toner supplying unit according to an embodiment of the present disclosure.

Various aspects of the present disclosure will now be described more fully with reference to the accompanying drawings, in which several embodiments are shown.

According to an embodiment of the present disclosure, an electrographic toner may have a core layer including a binder, a colorant and two or more types of releasing agents, and a shell layer covering the core layer. The binder may contain a non-crystalline polyester resin and a crystalline polyester resin. The amount of the non-crystalline polyester resin may be 70 weight (wt) % or more based on the total amount of the binder. The amount of the crystalline polyester resin may be 30 wt % or less based on the total amount of the binder. The non-crystalline polyester resin, the crystalline polyester resin, and a major releasing agent may accounts for 60% or more of the total amount of the two or more types of releasing agents. Such electrographic toner may satisfy the following:

$$SP(A)-SP(B)\geqq 3.0 \quad (1)$$

$$SP(B)-SP(W)\leqq 2.0 \quad (2)$$

$$10{,}000\leqq Mw(B)\leqq 30{,}000 \quad (3)$$

$$1.5\%\leqq Mw(B,\text{ less than }1{,}000)\leqq 5.0\% \quad (4),$$

where SP(A), SP(B) and SP(W) respectively denote solubility parameters (unit: $(J/cm^3)^{1/2}$) of the non-crystalline polyester resin, the crystalline polyester resin, and the major releasing agent, where Mw (B) denotes a weight average molecular amount of a THF-soluble component contained in the crystalline polyester resin measured by gel permeation chromatography (GPC), and where Mw (B, less than 1,000) denotes a molecular weight range of less than 1,000 g/mole of the THF-soluble component contained in the crystalline polyester resin measured by GPC.

The toner for developing an electrostatic latent image may include crystalline polyester resin and non-crystalline polyester (also called as amorphous polyester) resin. With regards to a differential scanning calorimetry (DSC), crystalline polyester resin refers to a resin having an endothermic peak that is clear, and not a stepped change in the amount of absorbed heat. For example, when the temperature increase rate is 10° C./minute, half of the endothermic peak has a width of 15° C. or less. The crystalline polyester resin may be used to improve gloss, stability, and low-temperature fixability of a toner image. In contrast, non-crystalline (amorphous) polyester resin refers to a resin of which the width of a half of an endothermic peak is higher than 15° C., or which has an endothermic peak that is not clear.

The melting point (Tm) of the crystalline polyester resin may be, for example, 60° C. to 80° C., or 65° C. to 75° C., but is not limited thereto. If the melting point (Tm) of the crystalline polyester resin is in the range of 60° C. to 80° C., the agglomeration of powder may be suppressed, preservation properties of a fixed image may be improved, and low-temperature fixability of toner may be obtained.

The melting point (Tm) of the crystalline polyester resin may be measured using a temperature corresponding to the endothermic peak obtained by Differential Scanning calorimetry (DSC). When the crystalline polyester resin is analyzed by DSC, the melting point (Tm) is immediately observed without a glass transition temperature. This is because the crystalline polyester resin has the melting point (Tm) alone and thus, when it is added to other resins, the melting points of the combined resins may be relatively lowered.

When the crystalline polyester resin, which has a low melting point, is added to the non-crystalline polyester resin, the melting point of toner containing the non-crystalline polyester resin and the crystalline polyester resin may be lowered due to the relatively low melting point of the crystalline polyester resin. That is, a sharp melting occurs by the crystalline polyester resin, thereby enabling low-temperature fixing. In addition, since the crystalline polyester resin does not have a glass transition temperature, the glass transition temperature of the material to which additives are not added, that is, the glass transition temperature of the non-crystalline polyester resin hardly changes and thus, durability and long-term preservation properties of toner may not be affected.

The crystalline polyester resin and the non-crystalline polyester resin may be prepared by performing a polycondensation method such as a direct polycondensation method or an ester-exchange method using aliphatic, alicyclic, aromatic polyvalent carboxylic acids, or alkylesters thereof, and polyhydric alcohols, esters of polyhydric alcohols, or hydroxycarboxylic acids in a water aqueous medium.

Examples of the polyvalent carboxylic acids used to obtain the crystalline polyester resin include, but are not limited to, oxalic acid, malonic acid, succinic acid, glutamic acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, acid anhydrides or acid chlorides thereof, and the like.

Examples of the polyhydric alcohols used to obtain the crystalline polyester resin include, but are not limited to, ethyleneglycol, diethyleneglycol, triethyleneglycol, 1,2-propyleneglycol, 1,3-propyleneglycol, 1,4-butanediol, 1,4-butendiol, neopentylglycol, 1,5-pentaneglycol, 1,6-hexaneglycol, 1,4-cyclohexanediol, 1,4-cyclohexanedimethanol, dipropyleneglycol, polyethyleneglycol, polypropyleneglycol, and the like.

Examples of the crystalline polyester resin include, but are not limited to, a polyester resin obtained by reacting 1,9-nonanediol with 1,10-decanedicarboxylic acid, or reacting cyclohexanediol with adipic acid, a polyester resin obtained by reacting 1,6-hexanediol with sebacic acid, a polyester resin obtained by reacting ethyleneglycol with succinic acid, a polyester resin obtained by reacting ethylene glycol with sebacic acid, a polyester resin obtained by reacting 1,4-butanediol with succinic acid, and the like.

The crystalline polyester resin may be an aliphatic crystalline polyester resin obtained by reacting a $C_{10}$-$C_{12}$ dicarboxylic acid with a $C_4$-$C_9$ diol. If the numbers of carbon atoms contained in the dicarboxylic acid and the diol are within the ranges described herein, the crystalline polyester resin may have a melting temperature that is appropriate for toner. In addition, since the crystalline polyester resin is aliphatic, a more linear resin structure may be obtained and thus, the affinity of the crystalline polyester resin with respect to the non-crystalline polyester resin may be increased.

According to another embodiment, the number of carbon atoms contained in the dicarboxylic acid may be equal to or greater than 10 and equal to or less than 12, and the number of carbon atoms contained in the diol may be equal to or greater than 6 and equal to or less than 9.

When the crystalline polyester resin is manufactured, the polymerization temperature may be in the range of about 180° C. to about 230° C. If needed, the reaction system may be controlled to be under reduced pressure, and water or alcohols generated during condensation may be removed during the reaction.

When the polymerizable monomers are not dissolved or are mutually dissolved at the reaction temperature, a solvent having a high-boiling point may be added as an auxiliary solubilizing solvent to dissolve the polymerizable monomers. Polycondensation may be carried out while the auxiliary solubilizing solvent is distilled away. When there is a polymerizable monomer that is poor in compatibility in copolymerization, the polymerizable monomer that is poor in compatibility may be previously condensed with a carboxylic acid component or alcohol component that is intended to be subject to polycondensation with the polymerizable monomer and polycondensed with a major component.

Examples of a catalyst useful in production of the crystalline polyester resin include, but are not limited to, alkali metal compounds of sodium, lithium, and the like; alkali earth metal compounds of magnesium, calcium, and the like; metal compounds of zinc, manganese, antimony, titanium, tin, zirconium, germanium, and the like; phosphite compounds; phosphate acid compounds; amine compounds, and the like.

Examples of the polyvalent carboxylic acids used to prepare the non-crystalline polyester resin include, but are not limited to, phthalic acid, isophthalic acid, terephthalic acid, tetrachlorophthalic acid, chlorophthalic acid, nitrophthalic acid, p-carboxyphenylacetic acid, p-phenylene-2-acetic acid, m-phenylenediglycolic acid, p-phenylenediglycolic acid, o-phenylenediglycolic acid, diphenylacetic acid, diphenyl-p, p'-dicarboxylic acid, naphthalene-1,4-dicarboxylic acid, naphthalene-1,5-dicarboxylic acid, naphthalene-2,6-dicarboxylic acid, anthracenedicarboxylic acid, cyclohexanedicarboxylic acid, and the like. In addition, examples of polyvalent carboxylic acids excluding the dicarboxylic acid may include, but are not limited to, trimellitic acid, pyromellitic acid, naphthalene tricarboxylic acid, naphthalene tetracarboxylic acid, pyrene tricarboxylic acid, pyrene tetracarboxylic acid, and the like.

Carboxylic groups of such carboxylic acids that have been derived from acid anhydrides, acid chlorides, or esters may also be used. For example, the non-crystalline polyester resin may be prepared using a terephthalic acid or lower ester thereof, diphenylacetic acid, or cyclohexane dicarboxylic acid. In this regard, the lower ester refers to an ester of an aliphatic alcohol having 1 to 8 carbon atoms.

Examples of the polyhydric alcohols used to prepare the non-crystalline polyester resin include, but are not limited to, aliphatic diols such as ethyleneglycol, diethyleneglycol, triethyleneglycol, propyleneglycol, butanediol, hexanediol, neopentylglycol, or glycerin, and the like; alicyclic diols such as cyclohexanediol, cyclohexanedimethanol, or hydrogen-added bisphenol A, and the like; and aromatic diols such as ethylene oxide adduct of bisphenol A, or propylene oxide adduct of bisphenol A, and the like.

These polyhydric alcohols may be used alone or in combination. For example, the non-crystalline polyester resin may be prepared using aromatic diols or alicyclic diols. In addition, in order to obtain good fixability, three or more-valent alcohols (e.g., glycerin, trimethylolpropane, or pentaerythritol, and the like) may also be used together with diols in order to form a cross-linked structure or a branched structure.

The non-crystalline polyester resin may be formed by condensing the polyhydric alcohols and the polyvalent carboxylic acids according to a conventionally known method. For example, the polyhydric alcohols, the polyvalent carboxylic acids, and if needed, a catalyst are loaded into a reaction container including a thermometer, an agitator, and reflux condenser and mixed. The mixture is heated at a temperature of 150 to 250° C. under inert gas (for example, nitrogen gas), and generated low molecular weight compounds are continuously removed outside the reaction system. The reaction is stopped when a predetermined acidic value is reached and the temperature is decreased, thereby obtaining a target reaction product.

Examples of a catalyst usable to synthesize the non-crystalline polyester resin include, but are not limited to, antimony-based, tin-based, titanium-based, aluminum-based catalysts, and the like. In particular, examples of the catalyst include an esterified catalyst of an organic metal, such as dibutyltin dilaurate or dibutyltin oxide, and the like; or metal alkoxide such as tetrabutyl titanate, and the like. Among these catalysts, titanium-based and aluminum-based catalysts are generally more environmentally friendly and stable. The amount of the catalyst may be in the range of 0.01 to 1.00 wt % based on the total weight of all source materials.

For the molecular weight of the THF-soluble component contained in the non-crystalline polyester measured by GPC, a weight average molecular amount (Mw) may be, for example, in the range of 5,000 to 60,000, or 7,000 to 50,000; a number average molecular weight (Mn) may be in the range of 2,000 to 10,000; and a molecular weight distribution (Mw/Mn) may be in the range of 1.5 to 10. If the weight average molecular amount and the number average molecular weight are within these ranges, the low-temperature fixability characteristics and resistance to hot-offset may be improved and a decrease in rigidity of the resin may be prevented, thereby improving the rigidity of an image fixed on a sheet. In addition, since a decrease in the glass transition temperature of toner is prevented, preservation characteristics such as blocking of toner are also improved.

In general, a polymerization toner using a polyester resin may be prepared using many components, and the structural design of a polymerization toner is regarded as an important factor to be considered. Thus, compatibility of the respective toner components needs to be reviewed. Solubility parameter (SP) is known as a factor related to the compatibility. Similar SP values mean high compatibility. However, there are also cases that do not satisfy the relationship, including cases in which compatibility needs to be determined using other factors excluding the SP. When the weight average molecular weight (Mw) and the Mw distribution are considered together with the SP, compatibility of the respective toner components may be explained in detail.

In order to satisfy low-temperature fixability, high gloss, and toner preservation characteristics under heat, the compatibility of toner components may need to be strictly controlled. If the Mw is too low or if the amount of low molecular weight toner particles is too high, even when there are significant differences in the SP values, the respective toner components may be used together to perform the plasticizing. In addition, although the releasing agent and the crystalline polyester resin needs slight compatibility, this does not mean the releasing agent and the crystalline polyester resin are completely mixed. That is, although technologically the releasing agent and the crystalline polyester resin are non-compatible to each other, the releasing agent and the crystalline polyester resin are compatible at an interface between materials or at a molecular level. This may also apply to the compatibility between a polyester resin that forms the core layer and a polyester resin that forms the shell layer. That is, if the polyester resins are compatible at the interface at a micro level, the adhesive properties between the core layer and the shell layer may be improved.

The binder may include 70 wt % or more, or 70 wt % to 99 wt %, or 80 wt % to 97 wt % of the non-crystalline polyester resin and 30 wt % or less, 1 wt % to 30 wt %, 3 wt % to 20 wt % of the crystalline polyester resin, based on the total weight of the binder of the core layer. If the binder includes 70 wt % or more of the non-crystalline polyester resin and 30 wt % or less of the crystalline polyester resin, based on the total weight of the binder, the rigidity of toner itself is sustained, a low-temperature fixability is obtained, image defects caused by contaminated units of an imaging system are prevented, and toner preservation characteristics under heat and charging characteristics of toner may be satisfactory.

The non-crystalline polyester resin (A), the crystalline polyester resin (B), and a major releasing agent (W) that accounts for about 60% or more of the total weight of the two or more types of releasing agents may satisfy the following equations (1) and (2):

$$\Delta SP(AB)=SP(A)-SP(B)\geqq 3.0 \quad (1);$$

and $$\Delta SP(BW)=SP(B)-SP(W)\leqq 2.0 \quad (2),$$

where SP(A), SP(B), and SP(W) denote a SP of the non-crystalline polyester resin, a SP of the crystalline polyester resin, and a SP of the major releasing agent, respectively.

The SP values may be calculated using an SP equation of Fedors below [Polym. Eng. Sci., vol. 14, pg. 147(1974)]:

$$SP=(\Delta Ev/V)^{1/2},$$

where ΔEv denotes an evaporation energy (cal/mol) and V denotes a molar volume ($cm^3$/mol).

In addition, SP may also be calculated using the following equation based on a composition ratio of used monomers:

$$SP=(\Delta Ev/V)^{1/2}=(\Sigma ei/\Sigma vi)^{1/2},$$

where ΔEv denotes an evaporation energy (cal/mol), V denotes a molar volume ($cm^3$/mol), Δei denotes an evaporation energy of each atom or an atomic group, and Δvi denotes a molar volume of each atom or an atomic group) (unit: the unit $(cal/cm^3)^{1/2}\times 2.046=(J/cm^3)^{1/2}$).

ΔSP(AB) may be 3 or more, for example, in the range of 3 to 6, or 3.5 to 5. When the ΔSP(AB) is 3 or more, the crystalline polyester resin may not be exposed to the surface of toner, or plasticizing by mixing the crystalline polyester resin with the non-crystalline polyester resin may be prevented. Thus, toner preservation characteristics under heat, and resistance to off-set when toner is fixed at high temperature may be improved.

ΔSP(BW) may be 2 or less, for example, 0.2 to 2, or 0.3 to 1.9. When ΔSP(BW) is 2 or less, the compatibility between the crystalline polyester resin and the major releasing agent is appropriately sustained, and thus crystallizing of the crystalline polyester resin may be prevented and satisfactory charging performance and low-temperature fixability characteristics may be obtained.

The releasing agents enable toner to be fixed to a final-image receptor at a low fixing temperature, and to have excellent final image durability and resistance to abrasion. Thus, characteristics of toner are very dependent on the type and amount of the releasing agent.

The two or more types of releasing agents may include, but are not limited to, two or more types of wax such as polyethylene-based wax, polypropylene-based wax, silicon wax, paraffin-based wax, ester-based wax, carnauba wax, metallocene wax, and the like. The releasing agents may have a melting point of about 50 to about 150° C. The releasing agents may be physically attached to toner particles, but are not covalently bonded with the toner particles, and thus enable the toner to be fixed to the final image receptor at a low temperature, and a final image to have excellent durability and resistance to abrasion.

The major releasing agent may be a paraffin-based wax. The amount of the major releasing agent may be, for example, about 60% or more, for example, in the range of 60 to 95%, or 65 to 90%, based on the total weight of all the releasing agents. If the amount of the major releasing agent is about 60% or more, the resistance to off-set when toner is fixed at high temperature and gloss characteristics may be improved.

A weight average molecular amount (Mw(B)) of a THF-soluble component contained in the crystalline polyester resin measured by Gel Permeation Chromatography (GPC), and a molecular weight region of less than 1,000 g/mole (Mw (B, less than 1,000)) of the THF-soluble component contained in the crystalline polyester resin measured by GPC, satisfy the following equations (3) and (4):

$$10{,}000\leqq Mw(B)\leqq 30{,}000 \quad (3);$$

and $$1.5\% \leqq Mw(B, \text{less than } 1{,}000) \leqq 5.0\% \quad (4).$$

For example, the weight average molecular amount (Mw (B)) of a THF-soluble component contained in the crystalline polyester resin may be in the range of 10,000 to 30,000, or 15,000 to 25,000. If the weight average molecular amount (Mw(B)) of a THF-soluble component contained in the crystalline polyester resin is in the range of 10,000 to 30,000, the resistance of a fixed image against bending may be increased, the compatibility of the crystalline polyester resin with respect to the non-crystalline resin or the releasing agents may be maintained at an appropriate level, thereby improving low-temperature fixability characteristics and charging performance.

In regards to a molecular weight distribution measured by GPC, a molecular weight region of $1.0\times10^3$ g/mole or less of a THF-soluble component of the toner may be in the range of, for example, 1.5% to 5%, or 1.5% to 4%.

The percentages may be calculated by integrating the molecular weight region of $1.0\times10^3$ g/mole or less in the GPC results. If the molecular weight region of $1.0\times10^3$ g/mole or less is in the range of 1.5% to 5%, the blocking of toner may be prevented, anti-document offset characteristics may be improved, and fusing and attaching of toner with respect to a transfer unit or an image carrier or formation of toner film may be prevented. In addition, excessive compatibility with respect to the releasing agents may be suppressed so that exfoliation occurring during oil-less fixation may be prevented, and toner preservation characteristics under heat may be improved.

The amounts of Si and Fe contained in the toner may each be in the range of, for example, about 3 to about 30,000 ppm, about 30 to about 25,000 ppm, or about 300 to 20,000 ppm. If the amounts of Si and Fe contained in the toner are each within this range, the charging properties of toner may be improved and contamination inside a printer using the toner may be prevented.

The binder of the toner may include but is not limited to a polyester resin alone or a mixture (hybrid) of a polyester resin and a polymer synthesized by polymerizing at least one polymerizable monomer.

According to an embodiment of the disclosure, a volume average particle diameter of the toner for developing an electrostatic latent image may be, for example, in the range of about 3 to about 8 μm, or about 4 to about 7.5 μm, or about 4.5 to about 7 μm. In general, the smaller the toner particle size, the higher the resolution and the higher the quality of an image. However, when a transfer speed and a cleansing force are taken into consideration, small toner particles may not be appropriate. Thus, it is important to have an appropriate toner particle size.

The volume average particle diameter of the toner may be measured by electrical impedance analysis. If the volume average particle diameter of the toner is greater than or equal to about 3 μm, it may be easier to clean a photoreceptor, mass-production yield is improved, and there arises no harmful effect on the human body caused by asbestos. On the other hand, if the volume average particle diameter of the toner is equal to or less than about 9 μm, this may lead to uniform charging, may improve fixing characteristics of the toner, and may make it easier to regulate a toner layer with a doctor blade.

The electrophotographic toner may have an average circularity in the range of about 0.950 to about 0.980, about 0.955 to about 0.975, or about 0.960 to about 0.970.

The circularity of the toner may be measured using a flow particle image analyzer (r.g., FPIA-3000 apparatus produced by SYSMEX Co., Inc.), and using the following equation:

$$\text{Circularity}=2\times(\pi\times\text{area})^{0.5}/\text{circumference}.$$

The circularity may be in the range of 0 to 1. As the circularity approaches 1, the toner particle shape becomes more circular.

When the electrophotographic toner has an average circularity of 0.950 or greater, an image developed on a transfer medium may have the appropriate thickness and thus, toner consumption may be reduced. In addition, the voids between toner particles may be smaller. The image developed on the transfer medium may have a sufficient coating rate. On the other hand, when the electrophotographic toner has an average circularity of 0.980 or less, an excessive amount of toner being supplied onto a development sleeve may be prevented, resulting in less contamination of the development sleeve with a coating of non-uniform toner.

Toner particle distribution coefficients may include a volume average particle size distribution coefficient (GSDv) or a number average particle size distribution coefficient (GSDp), which may be measured as follows.

A toner particle size distribution may be obtained from toner particle diameters measured using a Multisizer III (manufactured by Beckman Coulter Inc.). The toner particle diameter distribution is divided into predetermined particle diameter ranges (channels). With respect to the respective particle diameter ranges (channels), the cumulative volume distribution of toner particles and the cumulative number distribution of toner particles are measured, wherein, in each of the cumulative volume and number distributions, the particle size in each distribution is increased in a direction from the left to the right. A cumulative particle diameter at 16% of the respective cumulative distributions is defined as a volume average particle diameter D16v and as a number average particle diameter D16p. Likewise, a cumulative particle diameter at 50% of the respective cumulative distributions is defined as a volume average particle diameter D50v and as a number average particle diameter D50p. Likewise, a cumulative particle diameter at 84% of the respective cumulative distributions is defined as a volume average particle diameter D84v and a number average particle diameter D84p.

In this regard, the GSDv and the GSDp may be obtained using the relations that the GSDv is defined as $(D84v/D16v)^{0.5}$, and the GSDp is defined as $(D84p/D16p)^{0.5}$. The GSDv may be, for example, about 1.25 or less, or in the range of about 1.15 to about 1.20, and the GSDp may be, for example, about 1.30 or less, or in the range of about 1.15 to about 1.30 or about 1.20 to about 1.25. When each of the GSDv and GSDp is within the above range, the toner may have a uniform particle diameter.

Methods of preparing toner for developing an electrostatic latent images includes: mixing primary binder particles, a colorant dispersion, and a releasing agent dispersion including two or more types of releasing agents, thereby preparing a mixed solution; adding an agglomerating agent to the mixed solution to form a core layer including primary agglomerated toner; and covering the core layer with a shell layer including secondary binder particles formed by polymerizing one or more polymerizable monomers, thereby preparing secondary agglomerated toner, wherein the binder contains a non-crystalline polyester resin and a crystalline polyester resin, wherein the amount of the non-crystalline polyester resin is 70 weight (wt) % or more, and the amount of the crystalline polyester resin is 30 wt % or less, based on the total amount of the binder, and the non-crystalline polyester resin, the crystalline polyester resin, and a major releasing agent that accounts for 60% or more of the total amount of the two or more types of releasing agents satisfy the following:

$$SP(A)-SP(B)\geqq 3.0 \quad (1)$$

$$SP(B)-SP(W)\leqq 2.0 \quad (2)$$

$$10{,}000\leqq Mw(B)\leqq 30{,}000 \quad (3)$$

$$1.5\%\leqq Mw(B,\text{ less than }1{,}000)\leqq 5.0\% \quad (4),$$

where SP(A), SP(B), and SP(W) respectively denote solubility parameters (unit: $(J/cm^3)^{1/2}$) of the non-crystalline polyester resin, the crystalline polyester resin, and the major releasing agent, Mw (B) denotes a weight average molecular amount of a THF-soluble component contained in the crystalline polyester resin measured by gel permeation chromatography (GPC), and Mw (B, less than 1,000) denotes a molecular weight range of less than 1,000 g/mole of the THF-soluble component contained in the crystalline polyester resin measured by GPC.

The amounts of the non-crystalline polyester resin and the crystalline polyester resin that constitutes the binder, types of polyvalent carboxylic acids and polyhydric alcohols that are used to produce the non-crystalline polyester resin and the crystalline polyester resin, and methods of preparing the non-crystalline polyester resin and the crystalline polyester resin are the same as described herein.

The primary binder particles, which are prepared using such a polyester resin, may be prepared through inverse phase emulsification from a dispersion prepared by dispersing a polyester resin prepared through condensation polymerization, an alkali compound, and if required, a surfactant in water.

In particular, the primary binder particles may be prepared through any of three processes, i.e., dissolution, emulsification, and desolvation. Initially, in a dissolution process, a polyester resin solution may be prepared by dissolving a polyester resin in an organic solvent. Any organic solvent that can dissolve the polyester resin may be used without limitation. In an emulsification process, a basic compound and water are added to the polyester resin solution prepared in the dissolution process and subjected to phase inversion emulsification. A surfactant may be further added, if required. Herein, the amount of the basic compound may be determined based an equivalent ratio to the amount of the carboxylic acid calculated from the acid value of the polyester resin.

The resulting primary binder particles may have a particle size of about 1 μm or less, in the range of about 100 to about 300 nm, or in the range of about 150 to about 250 nm.

The primary binder particles may further include a charge controller. The charge controller may include a negatively charged charge controller or a positively charged charge controller. Examples of the negatively charged charge controller may include, but are not limited to, organic metal complexes such as a chromium containing azo complex or a monoazo metal complex, or chelate compounds; metal containing salicylic acid compounds wherein the metal may be chromium, iron, or zinc; and organic metal complexes such as aromatic hydroxycarboxylic acids or aromatic dicarboxylic acid, and the like. The positively charged type charge control agent may be a modified product such as nigrosine and a fatty acid metal salt thereof, or an onium salt including a quaternary ammonium salt such as tributylammonium 1-hydroxy-4-naphthalene sulfonate and tetrabutylammonium tetrafluoroborate. These charge control agents may be used alone or in combination of at least two thereof. The charge controller stably supports toner on a development roller with an electrostatic force. Thus, by using the charge controller, stable and high-speed charging may be ensured.

The primary binder particles obtained as described herein may be mixed with the colorant dispersion and the releasing agent dispersion to prepare a mixed solution. The colorant dispersion may be obtained by uniformly dispersing a composition including a colorant, such as a black colorant, a cyan colorant, a magenta colorant, or a yellow colorant, and an emulsifier by using an ultrasonic homogenizer or a micro fluidizer.

Among colorants used to prepare the colorant dispersion, the black colorant may be carbon black or aniline black. For color toner, at least one colorant including, but not limited to, the cyan colorant, the magenta colorant, and the yellow colorant may be further used in addition to the black colorant.

Examples of the yellow colorant may include, but are not limited to, a condensed nitrogen compound, an isoindolinone compound, an anthraquinone compound, an azo metal complex, or an allyl imide compound, and the like. Examples of the yellow colorant may include but are not limited to C.I. pigment yellows 12, 13, 14, 17, 62, 74, 83, 93, 94, 95, 109, 110, 111, 128, 129, 147, 168, 180, and the like.

Examples of the magenta colorant may include, but are not limited to, condensed nitrogen compounds, anthraquinone compounds, quinacridone compounds, base dye lake compounds, naphthol compounds, benzimidazole compounds, thioindigo compounds, perylene compounds, and the like. In particular, examples of the magenta colorant include but are not limited to C.I. pigment reds 2, 3, 5, 6, 7, 23, 48:2, 48:3, 48:4, 57:1, 81:1, 122, 144, 146, 166, 169, 177, 184, 185, 202, 206, 220, 221, 254, and the like.

Examples of the cyan colorant may include, but are not limited to, copper phthalocyanine compounds and derivatives thereof, anthraquinone compounds, base dye lake compounds, and the like. In particular, examples of the cyan colorant include but are not limited to C.I. pigment blues 1, 7, 15, 15:1, 15:2, 15:3, 15:4, 60, 62, 66, and the like.

These colorants may be used alone or in combination, and may be selected in consideration of color, chromaticity, brightness, weather resistance, or dispersibility in toner.

The amount of colorant may be any amount that is enough to colorize toner. For example, the amount of the colorant used to prepare the colorant dispersion may be, for example, in the range of about 0.5 to about 15 parts by weight, about 1 to about 12 parts by weight, or about 2 to about 10 parts by weight, based on 100 parts by weight of the toner. When the amount of the colorant is greater than or equal to 0.5 parts by weight based on 100 parts by weight of the toner, a sufficient coloring effect may be obtained. When the amount of the colorant is less than or equal to about 15 parts by weight based on 100 parts by weight of the toner, a sufficient electrification quantity may be obtained without a significant increase in the toner manufacturing costs.

The emulsifier used to prepare the colorant dispersion may be any emulsifier that is known in the art. For example, the emulsifier may be an anionic reactive emulsifier, a non-ionic reactive emulsifier, or a mixture thereof. The anionic reactive emulsifier may be HS-10 (manufactured by Dai-ichi Kogyo Inc.) or Dawfax 2-A1 (manufactured by Rhodia Inc.). The non-ionic reactive emulsifier may be RN-10 (manufactured by Dai-ichi Kogyo Inc.).

The releasing agent dispersion used in the method of preparing the toner includes a releasing agent, water, and/or an emulsifier. The releasing agent enables toner to be fixed to a final-image receptor at a low fixing temperature and to have excellent final image durability and resistance to abrasion. Thus, the characteristics of toner may dependent on the type and the amount of the releasing agent.

Examples of available releasing agents may include, but are not limited to, polyethylene-based wax, polypropylene-based wax, silicon wax, paraffin-based wax, ester-based wax, carnauba wax, and metallocene wax; and toner including at least two types of these releasing agents as a releasing agent. The releasing agent may have a melting point of about 50 to about 150° C. The releasing agent may be physically attached to the toner particles, but is not covalently bonded with the toner particles, and may thus enable the toner to be fixed to the final image receptor at a low temperature with excellent durability and resistance to abrasion.

The amount of the releasing agent may be, for example, in the range of about 1 to about 20 parts by weight, about 2 to about 16 parts by weight, or about 3 to about 12 parts by weight, based on 100 parts by weight of the toner. When the amount of the releasing agent is greater than or equal to about 1 part by weight based on 100 parts by weight of the toner, the toner may have good low-temperature fixing characteristics and a sufficiently wide fixing temperature range. When the amount of the releasing agent is less than or equal to about 20 parts by weight based on 100 parts by weight of the toner, the toner may have improved preservation characteristics and may be prepared at a lower manufacturing cost.

In addition, a mixture including ester-based wax and non-ester-based wax may also be used as a releasing agent. Since an ester group has high affinity with respect to the latex component of the toner, the wax may be uniformly distributed among toner particles so as to function effectively. The non-ester-based wax has a releasing effect on the latex, and thus may suppress excessive plasticizing reactions, which may occur when an ester-based wax is used exclusively. Therefore, the toner may retain satisfactory development characteristics for a long period of time.

Examples of the ester-based wax may include, but are not limited to, esters of monovalent to quinquevalent alcohols, and $C_{15}$-$C_{30}$ fatty acids such as esters of behenic acid, esters of stearic acid, esters of pentaerythritol, or esters montanic acid, and the like. Also, if an alcohol component constituting the ester is a monovalent alcohol, it may include 10 to 30 carbon atoms. If an alcohol component constituting the ester is a polyvalent alcohol, it may include 3 to 10 carbon atoms.

The non-ester-based wax may be polymethylene-based wax or paraffin-based wax.

Examples of the mixture including an ester-based wax and a non-ester-based wax may include a mixture of a paraffin-based wax and an ester-based wax. In particular, examples of the mixture including the ester-based wax and the non-ester-based wax may include, but are not limited to, P-212, P-280, P-318, P-319, P-420, and the like (manufactured by Chukyo Yushi Co., Ltd).

If the releasing agent is a mixture of a paraffin-based wax and an ester-based wax, the amount of the ester-based wax in the releasing agent may be, for example, in the range of about 5 to about 39 weight %, about 7 to about 36 weight %, or about 9 to about 33 weight %, based on the total weight of the mixture of a paraffin-based wax and an ester-based wax.

When the amount of the ester-based wax is greater than or equal to about 5 weight % based on the total weight of the mixture of a paraffin-based wax and an ester-based wax, the compatibility of the mixture with the binder may be sufficiently maintained. When the amount of the ester-based wax is less than or equal to about 39 weight % based on the total weight of the releasing agent, the toner may have appropriate plasticizing characteristics, and may thus retain satisfactory development characteristics for a long period of time.

The major releasing agent may be a paraffin-based material. The amount of the major releasing agent may be, for example, about 60% or more, 60 to 95%, or 65 to 90%, based on the total weight of the releasing agent.

Like the emulsifier used in the colorant dispersion, any emulsifier that is used in the art may be used as an emulsifier for the releasing agent. Examples of the emulsifier available for the releasing agent dispersion may include, but are not limited to, an anionic reactive emulsifier, a non-ionic reactive emulsifier, mixtures thereof, and the like. The anionic reactive emulsifier may be HS-10 (manufactured by Dai-ichi Kogyo Inc.) or Dawfax 2-A1 (manufactured by Rhodia Inc.). The non-ionic reactive emulsifier may be RN-10 (manufactured by Dai-ichi Kogyo Inc).

When prepared according to the methods described herein, the molecular weight, $T_g$, and rheological characteristics of the primary binder particles may be appropriately controlled in such a way that the toner may be fixed at low temperature.

The primary binder particles, the colorant dispersion, and the releasing agent dispersion as described herein, are mixed to obtain a mixed solution, and an agglomerating agent is added to the mixed solution, thereby preparing an agglomerated toner. In particular, after the latex particles, the colorant dispersion, and the releasing agent dispersion are mixed to obtain a mixed solution, an agglomerating agent is added thereto at a pH of 0.1 to 4.0, and subjected to agglomeration at a temperature of about 25 to about 70° C., for example, about 35 to about 60° C., which is lower than the glass transition temperature ($T_g$) of the primary binder particles, and to fusing at a temperature of about 85 to about 100° C. (a temperature that is about 30 to 50° C. higher than the $T_g$), thereby forming a primary agglomerated toner having a particle size of 4 to 7 μm.

Alternatively, in preparing the primary agglomerated toner, miniature toner having a particle size of 0.5 to 3 μm may be prepared first, followed by agglomeration to finally obtain the primary agglomerated toner having a particle size of 4 to 7 μm.

Once the primary agglomerated toner, which acts as a core, has been prepared, secondary latex particles, which act as a shell, are added, and the pH of the system is adjusted to 6 to 9 and left to stand until the particle size of the mixture is maintained constant for a predetermined period of time. The temperature may be raised to 90 to 98° C., and the pH lowered to 5 to 6 in order to coalesce the mixture into secondary agglomerated toner.

A Si and Fe-containing metal salt may be used as the agglomerating agent. When such a metal salt containing Si and Fe is used, the primary agglomerated toner may have a larger particle size due to the enhanced ionic strength and interparticular collisions. The Si and Fe-containing metal salt may be, but is not limited to, polysilicate iron. Examples of the Si and Fe-containing metals may include, but are not limited to, PSI-025, PSI-050, PSI-075, PSI-100, PSI-200, PSI-300, and the like, which are product names manufactured by Suido Kiko Co. Table 1 shows the physical properties and compositions of PSI-025, PSI-050, PSI-075, PSI-100, PSI-200 and PSI-300.

TABLE 1

| Type | | PSI-025 | PSI-050 | PSI-085 | PSI-100 | PSI-200 | PSI-300 |
|---|---|---|---|---|---|---|---|
| Si/Fe mole ratio | | 0.25 | 0.5 | 0.85 | 1 | 2 | 3 |
| Major component | Fe(wt %) | 5.0 | 3.5 | 2.5 | 2.0 | 1.0 | 0.7 |
| | $SiO_2$(wt %) | 1.4 | 1.9 | 2.0 | | 2.2 | |
| PH(1 w/v %) | | | | 2-3 | | | |
| Specific gravity (20° C.) | | 1.14 | 1.13 | 1.09 | 1.08 | 1.06 | 1.04 |
| Viscosity (mPa · S) | | | | 2.0 or more | | | |
| Average molecular weight (Dalton) | | | | 500,000 | | | |
| Appearance | | | | Transparent yellowish brown liquid | | | |

The amount of the agglomerating agent may be in the range of about 0.1 to about 10 parts by weight, about 0.5 to about 8 parts by weight, or about 1 to about 6 parts by weight, based on 100 parts by weight of the primary binder particles. In this regard, when the amount of the agglomerating agent is greater than or equal to about 0.1 parts by weight, agglomeration efficiency may increase. When the amount of the agglomerating agent is less than or equal to about 10 parts by weight, charging properties of the toner may not be degraded, and the particle size distribution may become more uniform.

The secondary binder particles may include, but are not limited to, a polyester resin alone, or a mixture (hybrid) of a polyester resin and a polymer synthesized by polymerizing at least one polymerizable monomer.

The primary binder particles may be prepared from a mixture of the polyester resin and a polymer prepared by polymerizing at least one polymerizable monomer. In this case, examples of the at least one polymerizable monomer used herein may include, for example, at least one styrene-based monomer including, but not limited to, styrene, vinyltoluene, or α-methylstyrene; acrylic acids, methacrylic acids; derivatives of (meth)acrylic acid including but not limited to methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, methacrylamide, and the like; ethylenically unsaturated monoolefines including but not limited to ethylene, propylene, butylene, and the like; halogenated vinyls including but not limited to vinyl chloride, vinylidene chloride, or vinyl fluoride, and the like; vinyl esters including but not limited to vinyl acetate or vinyl propionate, and the like; vinyl ethers including but not limited to vinyl methyl ether or vinyl ethylether, and the like; vinyl ketones including but not limited to vinyl methyl ketone or methyl isoproyl phenyl ketone, and the like; a nitrogen-containing vinyl compound including but not limited to 2-vinylpyridine, 4-vinylpyridine, or N-vinylpyrrolidone, and the like.

For efficient polymerization of the at least one polymerizable monomer, a polymerization initiator and a chain transfer agent may be further used.

Examples of the polymerization initiator may include, but are not limited to, persulfates such as potassium persulfate or ammonium persulfate, and the like; azo compounds such as 4,4-azobis-(4-cyanovaleric acid), dimethyl-2,2'-azobis(2-methylpropionate), 2,2-azobis(2-amidino-propane)dihydrochloride, 2,2-azobis-2-methyl-N-1,1-bis(hydroxymethyl)-2-hydroxy-ethylpropioamide, 2,2'-azobis(2,4-dimethylvaleronitrile), 2,2'-azobisisobutyronitrile, or 1,1'-azobis(1-cyclohexancarbonitrile), and the like; peroxides such as methylethylperoxide, di-t-butyl-peroxide, acetylperoxide, dikumylperoxide, lauroylperoxide, benzoylperoxide, t-butylperoxy-2-ethylhexanoate, di-isopropylperoxydicarbonate, or di-t-butylperoxyisophthalate, and the like. In addition, oxidation-reduction initiators prepared by combining these polymerization initiators. Further, reductants may also be used as the polymerization initiator.

A chain transfer agent refers to a material that changes the type of chain carrier when a chain reaction occurs, and includes materials that weaken the activity of a new chain to be less than the activity of existing chains. Due to the chain transfer agent, the degree of polymerization of polymerizable monomers may be reduced, and the reaction of a novel chain may be initiated. Also, as a result of using the chain transfer agent, the molecular weight distribution of the toner may be controlled.

The amount of the chain transfer agent may be, for example, in the range of about 0.1 to about 5 parts by weight, about 0.2 to about 3 parts by weight, or about 0.5 to about 2.0 parts by weight, based on 100 parts by weight of the at least one polymerizable monomer. If the amount of the chain transfer agent may be, for example, in the range of about 0.1 to about 5 parts by weight based on 100 parts by weight of the at least one polymerizable monomer, the molecular weight may be appropriately controlled and agglomeration efficiency and fixability may be improved.

Examples of the chain transfer agent may include, but are not limited to, sulfur-containing compounds such as dodecanethiol, thioglycolic acid, thioacetic acid, or mercaptoethanol, and the like; phosphorous acid compounds such as a phosphorous acid or sodium phosphorous acid, and the like; hypophosphorous acid compounds such as a hypophosphorous acid or a sodium hypophosphorous acid, and the like; alcohols such as methyl alcohol, ethyl alcohol, isopropyl alcohol, or n-butyl alcohol, and the like.

The resulting secondary binder particles may have a volume average diameter of, for example, about 1 μm or less, or in the range of about 100 to about 300 nm. Such secondary latex particles may also include a releasing agent, which may be incorporated into the secondary latex particles in a polymerization process.

The secondary agglomerated toner may be additionally coated with tertiary binder particles. The tertiary binder particles may also be prepared from a polyester resin alone or a mixture (hybrid) of a polyester resin and a polymer prepared by polymerizing at least one polymerizable monomer.

By forming the shell layer with the secondary binder particles or tertiary binder particles, the toner may have higher durability, and excellent preservation characteristics required for shipping and handling. In this regard, a polymerization inhibitor may be further added to prevent formation of new binder particles. In addition, a mixed monomer solution may be coated on the binder particles in starved-feeding conditions to ensure coating quality.

The obtained secondary agglomerated toner or tertiary agglomerated toner may be filtered to separate toner particles, and the toner particles may then be dried. An external additive may be added to the dried toner particles, and the amount of charge applied may be controlled, thereby obtaining the final dry toner.

The external additive may include, but is not limited to, silica or $TiO_2$. The amount of the external additive may be in the range of about 1.5 to about 7 parts by weight, or about 2 to about 5 parts by weight, based on 100 parts by weight of toner to which the external additive is not added. When the amount of the external additive is greater than or equal to about 1.5 parts by weight based on 100 parts by weight of toner to which the external additive is not added, caking that occurs as toner particles adhere to each other due to an interparticular agglomeration force may be prevented, and the amount of charge applied may be stable. When the amount of the external additive is less than or equal to about 7 parts by weight based on 100 parts by weight of toner to which the external additive is not added, the external additive may not contaminate a roller.

According to an embodiment of the disclosure, an imaging method includes forming a visible image by attaching toner to a surface of an image carrier on which an electrostatic image is formed, and transferring the visible image to a transfer medium, wherein the toner is the toner for developing an electrostatic latent image as described herein.

A representative electrophotographic imaging process includes a series of processes of forming images on a receptor, including charging, exposure to light, developing, transferring, fixing, cleaning, and erasing processes.

In the charging process, a surface of an image carrier is charged with negative or positive charges, whichever is desired, by a corona charger or a charge roller. In the exposure-to-light process, the charged surface of the image carrier is selectively discharged using a laser scanner or an array of diodes in an image-wise manner to form a latent image that corresponds to the final visual image to be formed on the image receptor. Electromagnetic radiation may be referred to as "light radiation," which may include but is not limited to infrared radiation, visible light radiation, ultraviolet radiation, and the like.

In the developing process, toner particles having an appropriate polarity contact the latent image on the image carrier. To this end, an electrically-biased developer having the same potential polarity as the polarity of the toner particles toner polarity may be used. The toner particles move to the image carrier, and selectively adhere to the latent image due to the electrostatic force and thus, forms a toner image on the image carrier.

In the transferring process, the toner image is transferred from the image carrier to the image receptor where a final image is formed. In some cases, an intermediate transferring element may be used to aid the transfer of the toner image from the image carrier to the final-image receptor.

In the fixing process, the toner image on the final image receptor is heated to soften or melt toner particles, thereby fixing the toner image to the final image receptor. Another method of fixing may involve fixing the toner image to the final-image receptor under high pressure with or without the application of heat.

In the cleaning process, residual toner remaining on the image carrier is removed.

Finally, in the charge-erasing process, the residual charges on the image carrier are exposed to light having a specific wavelength, and are thus uniformly erased resulting in a substantially lower amount of charges on the image carrier. Therefore, the residue of the latent image may be removed, and the image carrier is made available for a further imaging cycle.

According to an embodiment of the present disclosure, the toner supplying unit may include a toner tank for storing toner; a supplying part protruding towards the inside of the toner tank and supplying the stored toner outside; and a toner-agitating member that is rotatably installed inside the toner tank. The toner-agitating member may be used to agitate toner present in the entire inner space of the toner tank including the upper part of the supplying part, wherein the toner is the toner for developing an electrostatic latent image as described herein.

FIG. 1 is a view of a toner supplying unit 100 according to an embodiment. The toner supplying unit 100 may include a toner tank 101, a supplying part 103, a toner-conveying member 105, and a toner-agitating member 110.

The toner tank 101 stores an amount of toner, and may be formed in a substantially hollow cylindrical shape. The supplying part 103 is disposed at the inner bottom region of the toner tank 101, and externally discharges the toner contained in the toner tank 101. For example, the supplying part 103 may project from the bottom of the toner tank 101 inward, and may have a pillar shape with a semi-circular section. The supplying part 103 includes a toner outlet (not shown) in an outer side thereof, through which the toner is discharged.

The toner-conveying member 105 may be disposed at a side of the supplying part 103 at the inner bottom portion of the toner tank 101. The toner-conveying member 105 may have, for example, a coil spring shape. An end of the toner-conveying member 105 may extend inside the supplying part 103 so that the toner in the toner tank 101 is conveyed into the supplying part 103 as the toner-conveying member 105 rotates. The toner conveyed by the toner-conveying member 105 is externally discharged through the toner outlet.

The toner-agitating member 110 may be rotatably disposed inside the toner tank 101, and may force the toner in the toner tank 101 to move in a radial direction. For example, when the toner-agitating member 110 rotates in the middle of the toner tank 101, the toner in the toner tank 101 is agitated to prevent the toner from solidifying. The toner moves down to the bottom of the toner tank 101 due to gravity. The toner-agitating member 110 may include a rotation shaft 112 and a toner-agitating film 120. The rotation shaft 112 is rotatably disposed at the middle of the toner tank 101, and may have a driving gear (not shown) coaxially coupled with an end of the rotation shaft 112 projecting from the side of the toner tank 101 in such a manner that the rotation of the driving gear causes the rotation shaft 112 to rotate. The rotation shaft 112 may have an alar plate 114 to help fix the toner-agitating film 120 to the rotation shaft 112. The alar plate 114 may be formed to be substantially symmetric about the rotation shaft 112. The toner-agitating film 120 may have a width corresponding to the inner radius of the toner tank 101. The toner-agitating film 120 may be elastically deformable in consideration of the shape of a projection inside the toner tank 101, e.g., the supply part 103. The toner agitating film 120 may be cut into portions at an end of the toner agitating film 120 to form a first agitating part 121 and a second agitating part 122.

According to an embodiment of the present disclosure, an imaging apparatus may include an image carrier; an imaging unit for forming an electrostatic image on the surface of the image carrier; a toner housing unit; a toner supplying unit for supplying toner to the surface of the image carrier in order to develop the electrostatic image into a toner image on the surface of the image carrier; and a toner transfer unit for transferring the toner image on the surface of the image carrier onto a transfer medium, wherein the toner for developing the electrostatic latent image is prepared as described herein.

Figure 2:
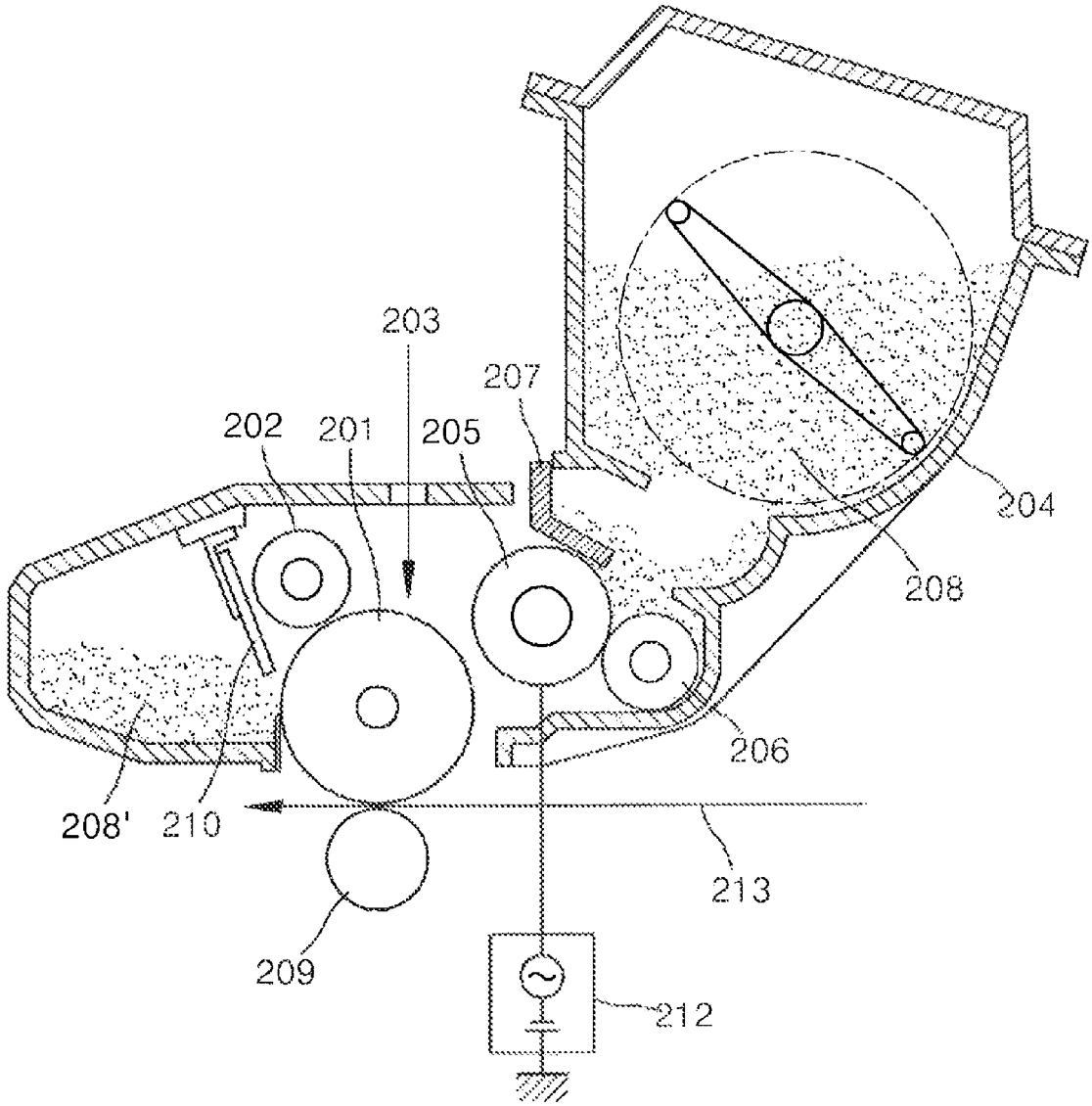
FIG. 2 is a schematic view of an imaging apparatus including toner manufactured according to an embodiment of the present disclosure.

FIG. 2 is a view of a non-contact development type imaging apparatus employing toner prepared by the methods according to the embodiments of the present disclosure.

A non-magnetic one-component developer, i.e., toner 208, in a developing device 204 is supplied to a developing roller 205 by a supply roller 206 formed of an elastic material, such as polyurethane foam or sponge. The toner 208 supplied onto the developing roller 205 reaches a contact portion between a developer-regulating blade 207 and the developing roller 205 as the developing roller 205 rotates. The developer-regulating blade 207 may be formed of an elastic material, such as metal or rubber. When the toner 208 passes through the contact portion between the developer-regulating blade 207 and the developing roller 205, the toner 208 is regulated to be a thin toner layer having a uniform thickness, and is sufficiently charged. The toner 208, which has been formed into a thin layer, is transferred to a development region of a photoreceptor 201 where a latent image is developed by the developing roller 205, wherein the photoreceptor 201 is an example of the image carrier. In this regard, the latent image is formed by scanning light 203 onto the photoreceptor 201.

The developing roller 205 is separated from the photoreceptor 201 by a predetermined distance, and is disposed to face the photoreceptor 201. The developing roller 205 rotates counterclockwise, and the photoreceptor 201 rotates clockwise.

The toner 208, which has been transferred to the development region of the photoreceptor 201, develops the latent image formed on the photoreceptor 201 into a toner image using an electric force generated due to a potential difference between a direct current (DC)-biased alternating current (AC) voltage applied to the developing roller 205 from the voltage source 212 and the latent potential of the photoreceptor 201 charged by a charging unit 202.

The toner image, which has been developed on the photoreceptor 201, reaches a transfer unit 209 as the photoreceptor 201 rotates. The toner image, which has been developed on the photoreceptor 201, is transferred to a print medium 213 by corona discharging, or by the transfer unit 209 having a roller shape and to which a high voltage having a polarity opposite to the toner 208 is applied, when the print medium 213 passes between the photoreceptor 201 and the transfer unit 209.

The toner image transferred to the print medium 213 passes through a high-temperature, high-pressure fusing device (not shown) and thus, is fused to the print medium 213, thereby resulting in a fixed image. The non-developed, residual developer remaining on the developing roller 205 is collected by the supply roller 206 contacting the developing roller 205 whereas the non-developed, residual developer 208' remaining on the photoreceptor 201 is collected by a cleaning blade 210. The processes described herein may be repeated to make additional images.

For further illustration of various aspects of the present disclosure, several specific examples will now be described. It should be understood however that these examples are for illustrative purposes only, and are not intended to limit the scope of the present disclosure.

EXAMPLES

Scanning electron microscopic (SEM) images of toners prepared according to the following examples were obtained to identify shapes of the toners. The circularity of the toners was obtained using an FPIA-3000 apparatus produced by SYSMEX Co., Inc., and using the equation below:

$$\text{Circularity}=2\times(\pi\times\text{area})^{0.5}/\text{circumference}.$$

The circularity may be in the range of 0 to 1, and as the circularity approaches 1, the toner particle shape becomes more circular.

Physical properties of non-crystalline polyester resin, and crystalline polyester resin used in the following preparation examples are shown in Tables 2 and 3.

TABLE 2

| Non-crystalline polyester resin | Mw | Mw less than 1,000 | Solubility parameter (SP) $(J/cm^3)^{1/2}$ | Glass transition temperature $T_g$ (° C.) |
|---|---|---|---|---|
| A-1 | $10.2\times10^3$ | 5.9% | 22.38 | 66 |
| A-2 | $17.6\times10^3$ | 6.3% | 22.69 | 72 |
| A-3 | $38.0\times10^3$ | 4.8% | 20.17 | 69 |
| A-4 | $47.4\times10^3$ | 1.7% | 22.44 | 72 |

TABLE 3

| Crystalline polyester resin | Mw | Mw less than 1,000 | Solubility parameter (SP) $(J/cm^3)^{1/2}$ | Melting Temperature $T_m$(° C.) |
|---|---|---|---|---|
| B-1 | $19.6\times10^3$ | 2.5% | 18.38 | 81 |
| B-2 | $18.0\times10^3$ | 2.4% | 21.07 | 89 |
| B-3 | $22.2\times10^3$ | 5.2% | 18.51 | 76 |
| B-4 | $48.5\times10^3$ | 1.9% | 18.97 | 58 |

In Tables 2 and 3, 'Mw' denotes a weight average molecular amount of a THF-soluble component contained in the respective polyester resins measured by GPC, and 'Mw less than 1,000' denotes a molecular weight range of less than 1,000 g/mole of the THF-soluble component contained in the respective polyester resins.

Preparation Example 1-1

Preparation of Latex A-1 Containing Binder A-1

500 g of polyester resin P-1, 400 g of methylethylketone (MEK) and 100 g of isopropylalcohol (IPA) were placed in a 3L double-jacketed reactor and dissolved at 30° C. while stirring with a mechanical anchor-type stirrer to obtain a polyester resin solution. A 10% aqueous ammonia solution was slowly added to the polyester resin solution with stirring, and 1,500 g of water was further added at a rate of 50 g/min with continuously stirring to prepare an emulsion. The solvent was removed from the emulsion by distillation at reduced pressure to obtain latex-1 having a 25% solid content. Hereinafter, the obtained solid is referred to as Binder A-1.

Preparation Example 1-2

Preparation of Latex A-2 Containing Binder A-2

Latex A-2 having a 25% solid content was prepared in the same manner as in Preparation Example 1-1, except that A-2 was used instead of A-1 as the polyester resin, and 10% ammonia aqueous solution was added until a pH reached 7 to 8. Hereinafter, the obtained solid is referred to as Binder A-2.

Preparation Example 1-3

Preparation of Latex A-3 Containing Binder A-3

Latex A-3 having a 25% solid content was prepared in the same manner as in Preparation Example 1-1, except that A-3 was used instead of A-1 as the polyester resin, and 10% ammonia aqueous solution was added until a pH reached 7 to 8. Hereinafter, the obtained solid is referred to as Binder A-3.

Preparation Example 1-4

Preparation of Latex A-4 Containing Binder A-4

Latex A-4 having a 25% solid content was prepared in the same manner as in Preparation Example 1-1, except that A-4 was used instead of A-1 as the polyester resin, and 10% ammonia aqueous solution was added until a pH reached 7 to 8. Hereinafter, the obtained solid is referred to as Binder A-4.

Preparation Example 2-1

Preparation of Latex B-1 Containing Binder B-1

Latex B-1 having a 25% solid content was prepared in the same manner as in Preparation Example 1-1, except that B-1 was used instead of A-1 as the polyester resin, and 10% ammonia aqueous solution was added until a pH reached 7 to 8. Hereinafter, the obtained solid is referred to as Binder B-1.

Preparation Example 2-2

Preparation of Latex B-2 Containing Binder B-2

Latex B-2 having a 25% solid content was prepared in the same manner as in Preparation Example 1-1, except that B-2 was used instead of A-1 as the polyester resin, and 10% ammonia aqueous solution was added until a pH reached 7 to 8. Hereinafter, the obtained solid is referred to as Binder B-2.

Preparation Example 2-3

Preparation of Latex B-3 Containing Binder B-3

Latex B-3 having a 25% solid content was prepared in the same manner as in Preparation Example 1-1, except that B-3 was used instead of A-1 as the polyester resin, and 10% ammonia aqueous solution was added until a pH reached 7 to 8. Hereinafter, the obtained solid is referred to as Binder B-3.

Preparation Example 2-4

Preparation of Latex B-4 Containing Binder B-4

Latex B-4 having a 25% solid content was prepared in the same manner as in Preparation Example 1-1, except that B-4 was used instead of A-1 as the polyester resin, and 10% ammonia aqueous solution was added until a pH reached 7 to 8. Hereinafter, the obtained solid is referred to as Binder B-4.

Preparation Example 3

Preparation of Colorant Dispersion 10 g in total of an anionic reactive emulsifier (HS-10; DAI-ICH KOGYO) and a nonionic reactive emulsifier (RN-10; DAI-ICH KOGYO) in ratios shown in Table 4 were added to a milling bath, together with 60 g of a colorant (cyan), and 400 g of glass beads each having a diameter of about 0.8 to about 1 mm, and milling was performed thereon at room temperature to prepare dispersions. The homogenizer used in this experiment may be an ultrasonic homogenizer or a micro fluidizer.

TABLE 4

| Color | Colorant | HS-10:RN-10 (parts by weight) |
|---|---|---|
| Cyan | PB 15:4 | 100:0 |
| | | 80:20 |
| | | 70:30 |

Preparation Example 4

Preparation of Releasing Agent Dispersion

P-280 (paraffin wax about 83%, synthesized ester wax about 17%; Tm 75° C.), P-212 (paraffin wax about 63%, synthesized ester wax about 37%; Tm 72° C.), and P-420 (paraffin wax about 80%, synthesized ester wax about 20%; Tm 89° C.), all of which were manufactured by Chukyo Yushi Co., Ltd, were used as a releasing agent dispersion. The SP of the paraffin wax was 17.52 $(J/cm^3)^{1/2}$.

Agglomeration and Preparation of Toner

Example 1

316 g of deionized water, 250 g of non-crystalline latex A-1 having a 25% solid content prepared in Preparation Example 1-1, and 57 g of crystalline latex B-1 having a 25% solid content prepared in Preparation Example 2-1, wherein non-crystalline latex A-1 and crystalline latex B-1 function as primary binder particles constituting a core layer, were placed in a 1L reactor and stirred at 350 rpm, 35 g of 19.5% cyan colorant dispersion (HS-10 100%) prepared in Preparation Example 3, and 28 g of 35% releasing agent dispersion P-420 (available from Chukyo Yushi Co., Ltd) prepared in Preparation Example 4 were added thereto to obtain a mixed solution. 30 g (0.3 mol) of a nitric acid, and 15 g of 12% PSI-100 (available from Suido Kiko Co.) as an agglomerating agent were added to the mixed solution, stirred using a homogenizer at a rate of 11,000 rpm for 6 minutes, and heated stepwise up to 50° C. while the temperature was increased by 1° C. per minute, thereby obtaining miniature toner. The miniature toner was agglomerated by increasing the temperature by 0.03° C. per minute to obtain primary agglomerated toner having a volume average diameter of about 4 to about 5 μm.

In this regard, as secondary binder particles, 150 g of latex A-4 having a 25 solid content prepared in Preparation Example 1-4 was added thereto and the reaction was performed for 0.5 hours. 1 mole NaOH was added thereto to control the pH to be about 9. After 20 minutes, the temperature was increased to 95° C. (0.5° C./min) and fusing was performed thereon for 3 hours, thereby obtaining a volume average diameter of about 5 to about 6 μm. The agglomerated reaction solution was cooled to a temperature lower than $T_g$ and filtered to isolate toner particles, followed by drying.

0.5 parts by weight of NX-90 (available from Nippon Aerosil), 1.0 part by weight of RX-200 (available from Nippon Aerosil), and 0.5 parts by weight of SW-100 (available from Titan Kogyo) were externally added to 100 parts by weight of the dried toner particles and stirred using a mixer (KM-LS2K, Daewha Tech.) at a rate of 8,000 rpm for 4 minutes. The resultant toner had a volume average diameter in the range of 5.84 to 6.0 μm. The toner had a GSDp of 1.20 and a GSDv of 1.23. The average circularity of the toner was 0.972.

Example 2

Toner having a potato-shape having a volume average diameter of 5.68 μm was obtained in the same manner as in Example 1, except that 250 g of non-crystalline latex A-2 having a 25% solid content prepared in Preparation Example 1-2 and 57 g of crystalline latex B-1 having a 25% solid content prepared in Preparation Example 2-1 were used as primary latex particles, and 28 g of P-280 was used as a releasing agent dispersion. The toner had a GSDp of 1.23 and a GSDv of 1.22. The average circularity of the toner was 0.974.

Comparative Example 1

Toner having a potato-shape having a volume average diameter of 5.94 μm was obtained in the same manner as in Example 1, except that 250 g of non-crystalline latex A-1 having a 25% solid content prepared in Preparation Example 1-1 and 57 g of crystalline latex B-2 having a 25% solid content prepared in Preparation Example 2-2 were used as primary latex particles. The toner had a GSDp of 1.24 and a GSDv of 1.25. The average circularity of the toner was 0.969.

Comparative Example 2

Toner having a potato-shape having a volume average diameter of 5.70 μm was obtained in the same manner as in Example 1, except that 250 g of non-crystalline latex A-3 having a 25% solid content prepared in Preparation Example 1-3 and 57 g of crystalline latex B-1 having a 25% solid content prepared in Preparation Example 2-1 were used as primary latex particles. The toner had a GSDp of 1.24 and a GSDv of 1.23. The average circularity of the toner was 0.973.

Comparative Example 3

Toner having a potato-shape having a volume average diameter of 5.80 μm was obtained in the same manner as in Example 1, except that 250 g of non-crystalline latex A-2 having a 25% solid content prepared in Preparation Example 1-2 and 57 g of crystalline latex B-3 having a 25% solid content prepared in Preparation Example 2-3 were used as primary latex particles. The toner had a GSDp of 1.21 and a GSDv of 1.22. The average circularity of the toner was 0.975.

Comparative Example 4

Toner having a potato-shape having a volume average diameter of 5.44 μm was obtained in the same manner as in Example 1, except that 250 g of non-crystalline latex A-2 having a 25% solid content prepared in Preparation Example 1-2 and 57 g of crystalline latex B-4 having a 25% solid content prepared in Preparation Example 2-4 were used as primary latex particles. The toner had a GSDp of 1.23 and a GSDv of 1.24. The average circularity of the toner was 0.973.

Evaluation of Toner

Calculation of Solubility Parameter (SP)

The SP was measured using the SP equation of Fedors below [Polym. Eng. Sci., vol 14, p 147(1974)]:

$$SP=(\Delta Ev/V)^{1/2},$$

where ΔEv denotes evaporation energy (cal/mol) and V molar volume ($cm^3$/mol)).

In addition, as for unit $(cal/cm^3)^{1/2}$, the obtained value was converted into a unit $(J/cm^3)^{1/2}$ by multiplying with 2.046. The results are shown in Table 5.

Evaluation of Weight Average Molecular Amount and Molecular Weight Region

Weight average molecular weight (Mw) of a toner was measured by a GPC chromatogram (Waters 2414). A refractive index and multi-angle light scattering (MALS) were used as a detector, and three columns, Styragel® HR 5, 4, and 2, were used.

A molecular weight region of 1,000 g/mole or less of a THF-soluble component contained in toner was calculated by integrating the molecular weight region of 1,000 g/mole or less in a chromatogram of the GPC.

Evaluation of Component that is Not Soluble in THF

An amount of the component that is not soluble in THF contained in toner was measured by filtering under reduced pressure using a glass filter (pore size of 40 to 100 μm, a filter paper, and a Celite® (SIGMA-ALDRICH, Celite® 545).

Gloss Evaluation

This experiment was performed using a glossmeter (manufacturer: BYK Gardner, and product name: micro-TRI-gloss) at a temperature of 160° C., which is the temperature at which the fixing device was used.

Evaluation angle: 60°

Evaluation pattern: 100% pattern

Fixing Characteristics Evaluation

Measurement device: Belt-type fixing device (Color laser 660, available from Samsung Electronics Co., Ltd.)

Unfixed image for testing: 100% pattern

Test temperature: 100 to 180° C. (interval of 10° C.)

Test paper: 60 g paper sheet (X-9, available from Boise), and 90 g paper sheet (exclusively available from Xerox)

Fixation speed: 160 mm/sec

Fixation time: 0.08 sec

This experiment was performed under the conditions as described herein, and fixability of the fixed image was evaluated in the following manner.

Optical density (OD) of the fixed image was measured and a 3M 810 tape was attached to the fixed image and 500 g of weight was reciprocated thereon five times and the tape used was removed. OD of the fixed image was also measured.

Fixability (%)={(OD after peeling off the tape)/(OD before peeling off the tape)}×100.

A fixing temperature region in which the fixability was 90% or more is regarded as a toner fixing region.

Minimum Fusing Temperature [minimum temperature at which 90% or more of the fixed image remains without cold-offset]

HOT Offset Temperature [minimum temperature at which hot-offset occurs]

Fixing Characteristics Evaluation 28.5 g of a carrier and 1.5 g of toner were loaded into a 60 mL gloss container and stirred with a tubular mixer. An electric field separation method was used to measure a particle charge of toner.

Toner charging stability with respect to a mixing hour at room temperature and room humidity, and the amount of toner charged at high-temperature and high-humidity/the amount of toner charged at low-temperature and low-humidity ratio were used for evaluation Room temperature and high-humidity: 23° C., RH 55%

High temperature and high-humidity: 32° C., RH 80%

High temperature and low-humidity: 10° C., RH 10% a significant change occurred (30% or more).

* Charging Stability.

O: A charging saturation curve with respect to a mixing hour is smooth and, after saturation charging, the change is negligible.

◎: A charging saturation curve with respect to a mixing hour is slightly non-uniform, or after saturation charging, a small change occurred (maximum 30%) (maximum 30%).

X: Charging with respect to a mixing hour is not saturated, or after saturation charging, a significant change occurred (30% or more).

* HH/LL ratio.

O: 0.55 or more

◎: 0.45 to 0.55

X: less than 0.45

Toner Fluidity Evaluation (Carr's Cohesion)

Equipment: Hosokawa micron powder tester PT-S

Amount of sample: 2 g (toner to which external additives were added or not added)

Amplitude: 1 mm_dial 3 to 3.5

Sieve: 53, 45, 38 μm

Oscillation Time: 120 second

After the sieves were placed at a temperature of 23° C. in RH 55% for 2 hours, the amount of toner in the respective sieves was measured before and after this experiment was performed under the conditions as described herein.

(1) [(Mass of powder in the largest sieve)/2 g]×100

(2) [(Mass of powder in the middle-sized sieve)/2 g]×100×(3/5)

(3) [(Mass of powder in the smallest sieve)/2 g]×100×(1/5)

Carr's Cohesion=(1)+(2)+(3)

Fluidity Evaluation Criteria

Δ: Cohesion of less than 10, high fluidity

O: Cohesion of 10-20,moderate fluidity

◎: Cohesion of greater than 20 to 40,slightly low fluidity

X: Cohesion of greater than 40,low fluidity a significant change occurred (30% or more).

Evaluation of High-Temperature Preservation Properties

External additives were added to 100 g of a toner and the resultant toner was loaded into a developing unit (manufacturer: Samsung Electronics Co., Ltd, Product name: Color laser 660 fixing device) and preserved in a constant-temperature and constant-humidity oven under the following conditions while being packaged.

23° C., 55% Relative Humidity (RH) 2 hours:

=>40° C., 90% RH 48 hours

=>50° C., 80% RH 48 hours

=>40° C., 90% RH 48 hours

=>23° C., 55% RH 6 hours

After preserved under the conditions as described herein, it was identified with the naked eye whether toner caking occurred in the developing unit, and a 100% image was output to evaluate image defects.

Evaluation Criteria

O: high-quality image, no-caking

Δ: low-quality image, no-caking

X: caking

Referring to Table 5, Toners (Examples 1 and 2) in which the non-crystalline polyester resin and the crystalline polyester resin have an appropriate difference in SP, the crystalline polyester resin and the releasing agent have an appropriate difference in SP, and the crystalline polyester resin has an appropriate Mw and an appropriate Mw distribution had high gloss properties, excellent low-temperature fixability, and excellent high-temperature preservation properties. However, the toner prepared in Comparative Example 1 having inappropriate SP differences had poor chargeability and poor high-temperature preservation properties, and the toner prepared in Comparative Example 2 in which the difference in SP between the non-crystalline polyester and the crystalline poly was appropriate and the difference in SP between the crystalline polyester and the releasing agent was inappropriate had poor high-temperature preservation properties. Like in Comparative Example 3, when the crystalline polyester had poor Mw distribution, the toner had low gloss properties and low fixability (HOT). Like in Comparative Example 4, when the crystalline polyester had too high Mw, the toner had unsatisfactory low-temperature fixability.

Accordingly, by strictly controlling compatibility between toner components by adjusting the difference in SP between a polyester and a releasing agent, which are used to form a core layer, toner having excellent low-temperature fixability, high gloss, and excellent high-temperature preservation characteristics may be obtained.

While the present disclosure has been particularly shown and described with reference to several embodiments thereof, it will be understood by those of ordinary skill in the art that various changes in form and details may be made thereto without departing from the principles and spirit of the present disclosure, the proper scope of which is defined in the following claims and their equivalents.

What is claimed is:

1. An electrographic toner, comprising:

a core layer including a binder, a colorant and two or more types of releasing agents; and a shell layer covering the core layer, wherein the binder contains a non-crystalline polyester resin and a crystalline polyester resin, the amount of the non-crystalline polyester resin being 70 weight (wt) % or more based on the total amount of the binder, the amount of the crystalline polyester resin being 30 wt % or less based on the total amount of the binder, and

TABLE 5

| | SP(A)-SP(B) | SP(B)-SP(W) | | Mw (B, 1,000 or less) | | Fixing characteristics | | Chargeability | | | | High-temp preservation |
|---|---|---|---|---|---|---|---|---|---|---|---|---|
| | (J/cm3)1/2 | (J/cm3)1/2 | Mw(B) | (%) | Gloss | MFT | HOT | Stability | HH/LL | | Fluidity | properties |
| Ex. 1 | 4.00 | 0.86 | $1.96 \times 10^4$ | 2.5 | 10.8 | 130° C. | 180° C. or more | ○ | 0.63 | ○ | ◎ | ○ |
| Ex. 2 | 4.31 | 0.86 | $1.96 \times 10^4$ | 2.5 | 11.5 | 120° C. | 180° C. or more | ○ | 0.62 | ○ | ◎ | ○ |
| Cp. Ex. 1 | 1.31 | 3.55 | $1.80 \times 10^4$ | 2.4 | 8.9 | 100° C. | 170° C. | Δ | 0.41 | X | ○ | Δ |
| Cp. Ex. 2 | 1.79 | 0.86 | $1.96 \times 10^4$ | 2.5 | 7.2 | 100° C. | 180° C. | Δ | 0.51 | Δ | Δ | X |
| Cp. Ex. 3 | 4.18 | 0.99 | $2.22 \times 10^4$ | 5.2 | 4.8 | 130° C. | 170° C. | ○ | 0.62 | ○ | ◎ | ○ |
| Cp. Ex. 4 | 3.28 | 1.45 | $4.85 \times 10^4$ | 1.9 | 5.8 | 150° C. | 180° C. or more | ○ | 0.60 | ○ | ◎ | ○ |

wherein the non-crystalline polyester resin, the crystalline polyester resin and a major releasing agent that accounts for 60% or more of the total amount of the two or more types of releasing agents satisfy the following:

$$SP(A)-SP(B)\geqq 3.0 \quad (1)$$

$$SP(B)-SP(W)\leqq 2.0 \quad (2)$$

$$10{,}000\leqq Mw(B)\leqq 30{,}000 \quad (3)$$

$$1.5\%\leqq Mw(B,\text{ less than }1{,}000)\leqq 5.0\% \quad (4),$$

where SP(A), SP(B) and SP(W) respectively denote solubility parameters (in units of $(J/cm^3)^{1/2}$) of the non-crystalline polyester resin, the crystalline polyester resin and the major releasing agent, Mw (B) denotes a weight average molecular amount of a tetrahydrofuran (THF)-soluble component contained in the crystalline polyester resin measured by gel permeation chromatography (GPC), and where Mw (B, less than 1,000) denotes a molecular weight range of less than 1,000 g/mole of the THF-soluble component contained in the crystalline polyester resin measured by GPC.

2. The electrographic toner of claim 1, wherein the two or more types of releasing agents comprises polyethylene-based wax, polypropylene-based wax, silicon wax, paraffin-based wax, ester-based wax, carnauba wax, or metallocene wax.

3. The electrographic toner of claim 1, wherein the major releasing agent comprises paraffin-based wax.

4. The electrographic toner of claim 1, wherein the toner further comprises about 3 to about 30,000 ppm of silicon (Si) and about 3 to about 30,000 ppm of iron (Fe).

5. The electrographic toner of claim 1, wherein the volume average particle diameter of the toner is in the range of about 3 to about 8 μm.

6. The electrographic toner of claim 1, wherein the average circularity of the toner is in the range of about 0.940 to about 0.980.

7. The electrographic toner of claim 1, wherein a volume average particle size distribution coefficient (GSDv) and a number average particle size distribution coefficient (GSDp) of the toner are about 1.25 or less and about 1.3 or less, respectively.

* * * * *